US005468310A

United States Patent [19]

Fujiki et al.

[11] Patent Number: 5,468,310

[45] Date of Patent: Nov. 21, 1995

[54] HIGH TEMPERATURE ABRASION RESISTANT COPPER ALLOY

[75] Inventors: Akira Fujiki; Makoto Kano, both of Yokohama, Japan

[73] Assignee: Nissan Motor Co., Ltd., Yokohama, Japan

[21] Appl. No.: 189,780

[22] Filed: Feb. 1, 1994

[30] Foreign Application Priority Data

Feb. 1, 1993 [JP] Japan ..... 5-014772
Feb. 4, 1993 [JP] Japan ..... 5-017670

[51] Int. Cl.[6] ..... C22C 9/01

[52] U.S. Cl. ..... 148/435; 148/436; 420/486; 420/489; 428/614

[58] Field of Search ..... 148/435, 436, 148/433, 434; 420/486, 489, 471, 478, 479, 480; 428/614

[56] References Cited

U.S. PATENT DOCUMENTS 2,907,653 10/1959 Holzwarth et al. ..... 420/489
3,117,002 1/1964 Klement ..... 420/489
3,147,113 9/1964 Klement ..... 420/489

FOREIGN PATENT DOCUMENTS 2075058 11/1981 United Kingdom .

OTHER PUBLICATIONS

"Non–Ferrous Metal", 14th edition, by Masataka Sugiyama, p. 73, 1978, Korona–sha.

"Metals Handbook", 9th edition, p. 433, 1979, American Society for Metals.

*Primary Examiner*—David A. Simmons
*Assistant Examiner*—Sean Vincent
*Attorney, Agent, or Firm*—Lowe, Price, LeBlanc & Becker

[57] ABSTRACT

A high temperature abrasion resistant copper alloy suitable for the material of engine parts such as valve seats and valve guides. The copper alloy comprising aluminum in an amount ranging from 1.0 to 15.0% by weight; at least one element selected from the group consisting of vanadium, niobium and tantalum in the group Va of the periodic table of elements, in an amount ranging from 0.1 to 5.0% by weight; and balance containing copper and impurities. The copper alloy has a structure in which at least one of intermetallic compounds is dispersed. each intermetallic compound contains at least one metal selected from the group consisting of aluminum and copper and at least one element selected from the group consisting of elements of the group Va of the periodic table. This copper alloy exhibits also high oxidation resistance and corrosion resistance at high temperatures.

4 Claims, 1 Drawing Sheet

HIGH TEMPERATURE ABRASION RESISTANT COPPER ALLOY

BACKGROUND OF THE INVENTION

1. Field of the Invention

This invention relates to improvements in a copper alloy, and more particularly to a copper alloy high in an abrasion resistance at high temperatures and suitable for the material of frictionally sliding members of an engine such as a valve seat and a valve guide for supporting a valve stem.

2. Description of the Prior Art

In recent years, automotive engines have been increasing in performance and power output, and therefore there has been a tendency that valve seats and valve guides are subjected to higher temperature and sliding bearing stress than conventional ones. Additionally, the valve seats and the valve guides have been required to have a better heat transmission in order to obtain both high power output and good fuel economy. Thus, high abrasion resistance and high coefficient of thermal conductivity have been required for the materials of the automotive engine parts such as the valve seats and the valve guides.

Research and development of such materials have been hitherto made around copper alloys. In this connection, the materials AlBC 1 to 4 (particularly AlBC 3) and similar AISI C95500 have been into practical use for valve seats or the likes. These materials are prepared by adding Ni and Fe to aluminum bronze. AlBC 1 to 4 are according to JIS (Japanese Industrial Standard) and discussed in a technical book "Non-Ferrous Metal", page 73, 14th edition, published in 1978 and written by Masataka Sugiyama and published by Korona-sha. AISI C95500 is discussed in "Metals Handbook 9th Edition Vol. 2", page 433, published in 1979 by American Society for Metals.

However, these conventional cupper alloy are not sufficient particularly in abrasion resistance at high temperatures in case that they are used as the valve seat and the valve guide of an automotive engine which are subjected to severe conditions required to obtain the high performance and high power output of the engine. In other words, there is the possibility that the engine parts of the conventional copper alloys become large in abrasion amount under such severe conditions, and therefore the copper alloy are not suitable for the engine parts.

SUMMARY OF THE INVENTION

It is an object of the present invention to provide an improved copper alloy which can overcome drawbacks encountered in conventional copper alloys.

Another object of the present invention is to provide an improved copper alloy which is excellent in abrasion resistance at high temperatures and thermal conductivity.

A further object of the present invention is to provide an improved copper alloy which is suitable for the material of parts of an engine which parts are subjected to severe friction at high temperatures, for example, valve seats and valve guides.

In view of the above, research and development have been made around aluminum bronze by the inventors in order to obtain a copper alloy which is excellent in abrasion resistance particularly at high temperatures. As a result, the inventors have found that a significant abrasion resistance at high temperatures can be obtained by a copper alloy comprising aluminum in an amount ranging from 1.0 to 1.5% by weight relative to the copper alloy and having a structure in which at least one of intermetallic compounds is dispersed, each intermetallic compound containing at least one metal selected from the group consisting of aluminum and copper.

Furthermore, it has been confirmed that, in case of using the copper alloy for the material of a valve seat or a valve guide of an engine, the valve seat or the like is excellent in abrasion resistance at high temperatures and less in offensive action against a corresponding valve. Additionally, the valve seat or the like is excellent also in coefficient of thermal conductivity thereby greatly contributing to providing a high power output and a high fuel economy for engines. Thus, the copper alloys of the present invention may be applicable for the material of a variety of frictional sliding members requiring characteristics similar to those of valve seats and valve guides.

An aspect of the present invention resides in a high temperature abrasion resistant copper alloy comprising: aluminum in an amount ranging from 1.0 to 15.0% by weight; titanium in an amount ranging from 0.3 to 8.0% by weight; and balance containing copper and impurities; the copper alloy having a structure in which at least one of intermetallic compounds is dispersed, each intermetallic compound containing at least two metals selected from the group consisting of aluminum, titanium and copper.

Another aspect of the present invention resides in a high temperature abrasion resistant copper alloy comprising: aluminum in an amount ranging from 1.0 to 15.0% by weight; at least one element selected from the group consisting of vanadium, niobium and tantalum in the group Va of the periodic table of elements, in an amount ranging from 0.1 to 5.0% by weight; and balance containing copper and impurities; the copper alloy having a structure in which at least one of intermetallic compounds is dispersed, each intermetallic compound containing at least one metal selected from the group consisting of aluminum and copper and at least one element selected from the group consisting of elements of the group Va of the periodic table.

DETAILED DESCRIPTION OF THE INVENTION

Figure 1:
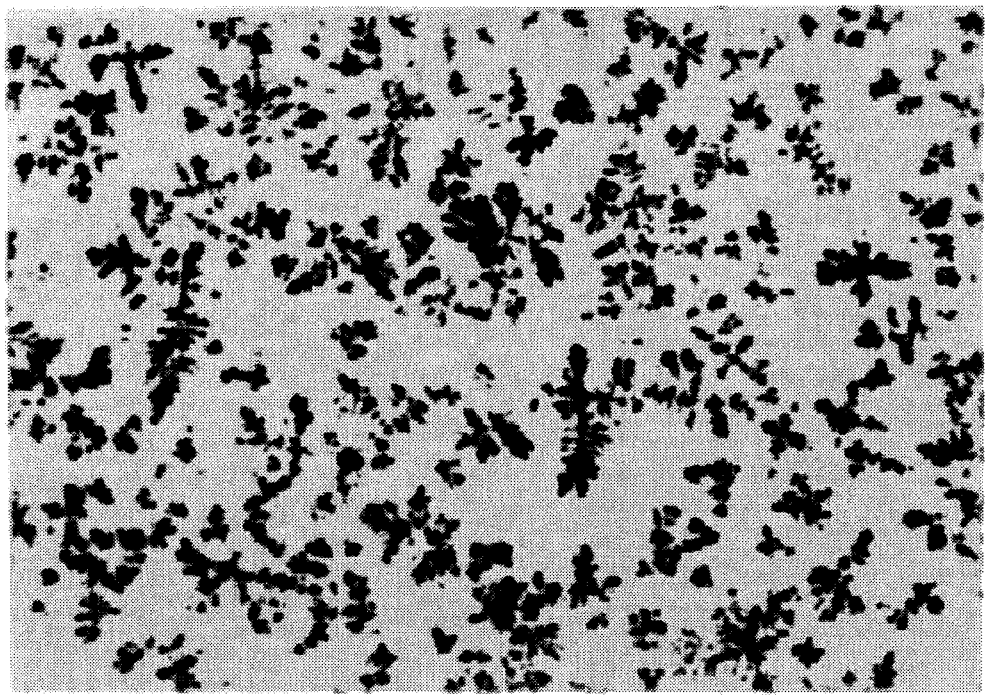
FIG. 1 is a microphotograph (at 400 magnifications) of the structure of a valve seat of Comparative Example 2-2, taken through an optical microscope.

According to the present invention, a high temperature abrasion resistant copper (Cu) alloy comprises Al (aluminum) in an amount ranging from 1.0 to 15.0% by weight relative to the copper alloy and has a structure in which at least one of intermetallic compounds is dispersed. Each intermetallic compound contains at least one metal selected from the group consisting of Al and Cu.

A first aspect of the present invention resides in a high temperature abrasion resistant copper alloy which comprises Al in an amount ranging from 1.0 to 15.0% by weight; titanium (Ti) in an amount ranging from 0.3 to 8.0% by weight; and balance containing Cu and impurities. The copper alloy has a structure in which at least one of intermetallic compounds is dispersed. Each intermetallic compound contains at least two metals selected from the group consisting of Al, Ti and Cu. Accordingly, in the structure of the copper alloy, at least one of intermetallic compounds such as Al-Ti, Cu-Ti and Al-Ti-Cu is dispersed.

Hereafter, discussion will be made on components of the copper alloy of the first aspect of the present invention.

Al:

Al in the copper alloy is contained in a matrix, forming a solid solution, and contributes to increasing a physical strength and a hardness at high temperatures thereby improving an abrasion resistance of the copper alloy at high temperatures. Additionally, Al combines with Ti, Co (cobalt), Fe (iron), Ni (nickel) and the like mentioned after to form intermetallic compounds and/or composite intermetallic compounds which are to be precipitated, thereby improving a heat resistance and an abrasion resistance of the copper alloy. The content of Al in the copper alloy is within a range of from 1.0 to 15.0% by weight relative to the copper alloy. If the content is less than 1.0% by weight, the above-mentioned advantageous effects are not sufficiently obtained. If the content of Al exceeds 15.0% by weight, the copper alloy is embrittled and lowered in thermal conductivity.

Ti:

Ti in the copper alloy is contained in the matrix, forming a solid solution, and contributes to increasing a physical strength and a hardness at high temperatures. Further, Ti combines with Cu to form intermetallic compounds and combines with Al and Co to form intermetallic compounds and composite intermetallic compounds thereby improving an abrasion resistance of the copper alloy at high temperatures. The content of Ti is determined within a range of from 0.3 to 8.0% by weight relative to the copper alloy. If the content of Ti is less than 0.3% by weight, the above advantageous effects cannot sufficiently obtained. If the content exceeds 8.0% by weight, an oxidation tends to be liable occur in the copper alloy while embrittling the copper alloy.

The copper alloy of the first aspect optionally comprises Co in an amount ranging from 0.5 to 10.0% by weight relative to the copper alloy, and has a structure in which at least one of intermetallic compounds is dispersed. Each intermetallic compound contains at least two metal selected from the group consisting of Al, Ti, Co and Cu. Accordingly, at least one of intermetallic compounds such as Al-Ti, Cu-Ti, Co-Ti, Al-Ti-Co and Al-Ti-Cu are dispersed in the structure of the copper alloy. Co in the copper alloy will be discussed in detail.

Co:

Co in the copper alloy is contained in the matrix forming a solid solution thereby to improve a heat resistance and an abrasion resistance of the copper alloy. Co combines with Cu and/or Ti to form intermetallic compounds and combines with Al and Ti and with Cu and Ti to form composite intermetallic compounds thereby improving a heat resistance and an abrasion resistance of the copper alloy. The content of Co is determined within a range of from 0.5 to 10.0% by weight relative to the copper alloy. If the content is less than 0.5% by weight, the above advantageous effects cannot be sufficiently obtained. If the content exceeds 10.0% by weight, the thermal conductivity of the copper alloy lowers.

The copper alloy of the first aspect further optionally comprises at least one of Fe and Ni in an amount ranging from 0.5 to 12.0% by weight, and has a structure in which at least one of intermetallic compounds is dispersed. Each intermetallic compound contains at least two metals selected from the group consisting of Al, Ti, Co, Fe, Ni and Cu. Accordingly, one of intermetallic compounds such as Al-Ti, Cu-Ti, Co-Ti, Cu-Co, Fe-Al, Ni-Al, Al-Ti-Cu, Al-Ti-Co, Ti-Cu-Co and Fe-Ni-Al is dispersed in the structure of the copper alloy. Fe and/or Ni in the copper alloy will be discussed in detail.

Fe and/or Ni:

Fe and/or Ni in the copper alloy mainly combine with Al to form intermetallic compounds thereby improving a heat resistance and an abrasion resistance. The total content of Fe and/or Ni is decided within the range from 0.5 to 12.0% by weight relative to the copper alloy. If the content is less than 0.5% by weight, the above-mentioned advantageous effects cannot be sufficiently obtained. If the content exceeds 12.0% by weight, the copper alloy is lowered in thermal conductivity and embrittled.

The copper alloy of the first aspect further optionally comprises Mn (manganese) in an amount ranging from 1.0 to 10.0% by weight relative to the copper alloy, and has a structure in which at least one of the above-mentioned intermetallic compounds is dispersed. Mn in the copper alloy will be discussed in detail.

Mn:

Mn in the copper alloy functions to granulate the structure of aluminum bronze thereby improving a physical strength of the copper alloy, while preventing a slow cooling embrittlement of the copper alloy. Additionally, Mn is contained in the matrix forming a solid solution thereby improving a physical strength and an abrasion resistance of the copper alloy. The content of Mn is determined within the range of from 1.0 to 10.0% by weight relative to the copper alloy. If the content is less than 1.0% by weight, the above advantageous effects cannot be sufficiently obtained. If the content exceeds 10.0% by weight, embrittlement occurs in the copper alloy.

Thus, the copper alloy of the first aspect is high in heat resistance, abrasion resistance and efficiency of thermal conductivity. Consequently, in case that the copper alloy is used for the material of a valve seat or a valve guide of an internal combustion engine, the valve seat or the valve guide exhibits a high abrasion resistance at high temperatures and a high heat transmission ability due to its high thermal conductivity, thereby greatly contributing to improving the power output and the fuel economy of the engine.

The above embodiment will be more readily understood with reference to Examples in comparison with Comparative Examples; however, these Examples are intended to illustrate the embodiment and are not to be construed to limit the scope of the invention.

EXAMPLES 1-1 to 1-9 and 1-12 and COMPARATIVE EXAMPLES 1-1, 1-2 and 1-5

Raw materials (metals) were molten in a graphite crucible by using a high frequency induction furnace to obtain a copper alloy molten metal having a composition shown in the column of Examples 1-1 to 1-9 and 1-12 in Tables 1, 2 and 3 and Comparative Examples 1-1, 1-2 and 1-5 in Tables 4 and 5. The copper alloy molten metal was then cast to form an ingot. The ingot was subjected to hot forging and hot extrusion at 780° C. to form an extruded material. Subsequently, cutting was made on the extruded material thus producing a valve seat of Examples 1-1 to 1-9 and 1-12 and Comparative Examples 1-1, 1-2 and 1-5. The valve seat was press-fitted in a dummy cylinder head formed of a material AC4B (according to JIS), for the purpose of abrasion resistance evaluation.

EXAMPLES 1-10, 1-13 and 1-15 and COMPARATIVE EXAMPLES 1-3, 1-6 and 1-8

Raw materials (metals) were molten in a graphite crucible by using a high frequency induction furnace to obtain a copper alloy molten metal having a composition shown in the column of Examples 1-10, 1-13 and 1-15 in Tables 2 and 3 and Comparative Examples 1-3, 1-6 and 1-8 in Tables 4 and 5. The copper alloy molten metal was powdered by gas atomization and then subjected to dehydration and particle size distribution control thereby producing metal powder for powder metallurgy. After lubricant was added to the metal powder, the metal powder was molded into a predetermined shape and dewaxed. Subsequently, the molded metal powder was sintered thus producing a valve seat of Examples 1-10, 1- 13 and 1-15 and Comparative Examples 1-3, 1-6 and 1-8. The thus produced valve seat was press-fitted in a dummy cylinder head formed of a material AC4B (according to JIS), for the purpose of abrasion resistance evaluation.

EXAMPLES 1-11, 1-14 and 1-16 and COMPARATIVE EXAMPLES 1-4 and 1-7

Raw materials (metals) were molten in a graphite crucible by using a high frequency induction furnace to obtain a copper alloy molten metal having a composition shown in the column of Examples 1-11, 1-14 and 1-16 in Table 3 and Comparative Examples 1-4 and 1-7 in Tables 4 and 5. The copper alloy molten metal was powdered by gas atomization and then subjected to dehydration and particle size distribution control thereby producing metal powder for padding or overlaying. This metal powder was padded or overlaid, using $CO_2$ laser, at a portion (corresponding to a valve seat) of a dummy cylinder head formed of a material AC4B (according to JIS). Thereafter, machining was made on the dummy cylinder valve seat portion thereby obtaining the dummy cylinder head provided with a valve seat of Examples 1-11, 1-14 and 1-16 and Comparative Examples 1-4 and 1-7, for the purpose of abrasion resistance evaluation.

ABRASION TEST

Evaluation of abrasion resistance of the copper alloy (or the valve seat) of Examples and Comparative Examples was conducted upon an abrasion test as follows: Each cylinder head provided with the above-mentioned valve seat of Examples 1-1 to 1-16 and Comparative Examples 1-1 to 1-8 was assembled in a dummy engine or testing machine. The dummy engine was operated at an engine speed of 3500 r.p.m. at a temperature of 250° C. for a time of 20 hours. After this abrasion test (dummy engine operation), the abrasion amount of the valve seat was measured while observing the appearance of the valve seat. The results are shown in Tables 1 to 5.

As apparent from Tables 1 to 3, the valve seats of Examples (or according to the embodiment of the present invention) were all less in abrasion amount thereby exhibiting an excellent abrasion resistance at a high temperature. Additionally, these valve seats maintained their normal appearance even after the abrasion test while demonstrating the fact that they did not injure a valve frictionally contactable to the valve seat.

Additionally, it was recognized that the valve seats (e.g., Examples 1-3 and 1-7) formed of a molten metal material and the valve seats (e.g., Examples 1-13 and 1-15) formed of a sintered metal material were similar in abrasion resistance as long as they had similar compositions. In case of using the sintered metal material, although an operation step for preparing the metal powder was required, an intermediate product could be formed in a shape (or a near-net-shape) similar to the final product so that there was an advantage in which an extrusion process and a finishing machining were unnecessary.

Furthermore, comparing the valve seats (e.g., Examples 1-5 and 1-9) formed of the molten metal material and the valve seats (e.g., Examples 1-14 and 1-16) formed of a padded material, the ones of the padded material was slightly low in abrasion amount to exhibit a better abrasion resistance than ones of the molten metal material although both are similar in composition. The reason why such a difference in abrasion resistance was considered as follows: The padded material was cooled with the cylinder head made of the aluminum alloy high in thermal conductivity thereby to form a quenched structure, and therefore the padded material became of a fine structure thereby to improve the abrasion resistance even if it was maintained in a state as it was padded on the cylinder head. Additionally, if a heat treatment is made on the padded material to precipitate intermetallic compounds, the number of nuclei increases, so that fine precipitate will be dispersed in the structure thereby improving an abrasion resistance.

On the contrary, in case of the valve seats (e.g., Comparative Examples 1-1, 1-3, 1-4 and 1-5) formed of a material which was smaller in content of Al, Ti and Co than that of the first aspect of the present invention, abrasion amount was larger than that in the valve seats of the first aspect of the present invention. In case of the valve seat (e.g., Comparative Example 1-2) formed of a material which was larger in content of Al and Ti than that of the first aspect of the present invention, abrasion amount was smaller than that in the valve seats of the first aspect of the present invention; however, pittings (pit-like abrasion traces) were found on the surface of the valve seat of Comparative Example 1-2 after the abrasion test.

Thus, effects of adding Fe, Ni and Mn were recognized upon comparison of Examples and Comparative Examples. However, it was also recognized that no advantageous effect was obtained if the addition amount of the above metals is less than the range of the first aspect of the present invention, whereas the pittings or the like was formed if the addition amount was more than the range of the first aspect of the present invention as in the cases of Comparative Examples 1-6 and 1-7.

Furthermore, in case of the valve seat of Comparative Example 1-8 which had the composition within the range of the first aspect of the present invention but had a structure in which no intermetallic compound precipitated, the abrasion resistance was interior as compared with the valve seats of the first aspect of the present invention. This revealed advantageous effects due to precipitation and dispersion of the intermetallic compounds in the copper alloy.

As appreciated from the above, the copper alloys of the first aspect of the present invention exhibited excellent abrasion resistances at the high temperature. In case of using the copper alloys for the materials of a valve seat or a valve guide of an engine, the valve seat or the like is excellent in abrasion resistance at high temperatures and less in offensive action against a frictionally contactable valve. Additionally, the valve seat or the like is excellent also in coefficient of thermal conductivity thereby greatly contributing to providing high power output and high fuel economy engines.

A second aspect of the present invention resides in the high temperature abrasion resistant copper alloy which comprises Al in an amount ranging from 1.0 to 15.0% by weight; at least one element selected from the group consisting of V (vanadium), Nb (niobium) and Ta (tantalum) in the group Va of the periodic table of elements, in an amount ranging from 0.1 to 5.0% by weight; and balance containing Cu and impurities. The copper alloy has a structure in which at least one intermetallic compound is dispersed. Each intermetallic compound contains at least one metal selected from the group consisting of Al and Cu, and at least one element in the group Va of the periodic table of elements.

Hereafter, discussion will be made on components of the copper alloy of the second aspect of the present invention.

Al:

Al in the copper alloy is contained in a matrix, forming a solid solution, and contributes to increasing a physical strength and a hardness at high temperatures thereby improving an abrasion resistance of the copper alloy at high temperatures. Additionally, Al combines with the elements of the group Va in the periodic table of elements, Co, Fe, Ni and the like mentioned after to form intermetallic compounds and/or composite intermetallic compounds which are to be precipitated, thereby improving a heat resistance and an abrasion resistance of the copper alloy. The content of Al in the copper alloy is determined within a range of from 1.0 to 15.0% by weight relative to the copper alloy. If the content is less than 1.0% by weight, the above-mentioned advantageous effects are not sufficiently obtained. If the content of Al exceeds 15.0% by weight, the copper alloy is embrittled and lowered in thermal conductivity.

The group Va elements:

The group Va elements such as V, Nb, Ta and the like in the copper alloy combine with Cu, Al and Co to form intermetallic compounds which are spherical or block-shaped and rich in the group Va elements, having a grain diameter of about 10 μm, and another intermetallic compounds which are of the form wherein precipitates are arranged resin-like or circular and poor in the group Va elements, having a grain diameter of about 1 μm. Thus, the group Va elements greatly contributes to improving an abrasion resistance at high temperatures and a resistance against abrasive materials. The content of the group Va elements in the copper alloy is determined within a range of from 0.1 to 5.0% by weight relative to the copper alloy. If the content is less than 0.1% by weight, the above-mentioned advantageous effects cannot be sufficiently obtained. If the content exceeds 5.0% by weight, the group Va elements cannot be merged in the matrix of aluminum bronze so as to segregate.

The copper alloy of the second aspect optionally comprises Co in an amount ranging from 0.5 to 10.0% by weight relative to the copper alloy, and has a structure in which at least one of intermetallic compounds is dispersed. Each intermetallic compound contains at least one metal selected from the group consisting of Al, Co and Cu and at least one element of the group Va elements of the periodic table. Co in the copper alloy will be discussed in detail.

Co:

Co in the copper alloy is contained in the matrix, forming a solid solution, thereby to improve a heat resistance and an abrasion resistance of the copper alloy. Co combines with Cu to form intermetallic compounds, and further combines with the group Va elements, Cu and Al and/or Ti to form a variety of composite intermetallic compounds. The content of Co in the copper alloy is determined within a range of from 0.5 to 10.0% by weight relative to the copper alloy. If the content is less than 0.5% by weight, the above advantageous effects cannot be sufficiently obtained. If the content exceeds 10.0% by weight, the thermal conductivity of the copper alloy lowers.

The copper alloy of the second aspect further optionally comprises at least one of Fe and Ni in an amount ranging from 0.5 to 12.0% by weight, and has a structure in which at least one of intermetallic compounds is dispersed. Each intermetallic compound contains at least one element selected from the group consisting of Al, Co, and Cu and at least one element selected from the elements of the group Va of the periodic table of elements. Fe and/or Ni in the copper alloy will be discussed in detail.

Fe and/or Ni:

Fe and/or Ni in the copper alloy mainly combines with Al and/or the group Va elements to form intermetallic compounds thereby improving a heat resistance and an abrasion resistance of the copper alloy. The total content of Fe and/or Ni is determined within the range from 0.5 to 12.0% by weight relative to the copper alloy. If the content is less than 0.5% by weight, the above-mentioned advantageous effects cannot be sufficiently obtained. If the content exceeds 12.0% by weight, the copper alloy is lowered in thermal conductivity and embrittled.

The copper alloy of the second aspect further optionally comprises Mn in an amount ranging from 1.0 to 10.0% by weight relative to the copper alloy, and has a structure in which at least one of the above-mentioned intermetallic compounds is dispersed. Mn in the copper alloy will be discussed in detail.

Mn:

Mn in the copper alloy functions to granulate the structure of aluminum bronze thereby improving a physical strength of the copper alloy, while preventing a slow cooling embrittlement of the copper alloy. Additionally, Mn is contained in the matrix, forming a solid solution, thereby improving a physical strength and an abrasion resistance of the copper alloy. The content of Mn is determined within a range of from 1.0 to 10.0% by weight relative to the copper alloy. If the content is less than 1.0% by weight, the above advantageous effects cannot be sufficiently obtained. If the content exceeds 10.0% by weight, embrittlement occurs in the copper alloy.

As appreciated from the above, in the structure of the copper alloy of the second aspect, at least one of intermetallic compounds such as Al-V, Cu-V, Al-Nb, Cu-Nb, Al-Ta, Cu-Ta, Al-Cu-V, Al-Co-V, Cu-Co-V, Al-Cu-Nb, Al-Co-Nb, Cu-Co-Nb, Al-Cu-Ta, Al-Co-Ta and Cu-Co-Ta is dispersed. Intermetallic compounds such as Cu-Co, Fe-Al, Ni-Al and Al-Fe-Ni may be suitably disposed, in which the intermetallic compounds are formed by at least two of Al, Co, Fe, Ni and Cu. Accordingly, this copper alloy exhibits an excellent abrasion resistance at high temperatures and high oxidation and corrosive abrasion resistances. Additionally, by virtue of addition of V, Nb and/or Ta in place of Ti, the following advantageous effects can be obtained: In case of padding or overlaying the copper alloy on a valve seat by using a laser, a greatly improved padded or overlaid layer can be formed because V, Nb and Ta are prevented from being selectively oxidized even through laser-padding or overlaying operation is made in atmospheric air. Besides, corrosive abrasion due to leaded gasoline can be largely suppressed because V, Nb and Ta are prevented from their selective corrosion by corrosive combustion product components. It will be understood that the copper alloy of the second aspect is not limited to use for the material of valve seats and valve guides and therefore may be used for the material of other sliding members or parts used at high temperature conditions, of engines or the like.

The high temperature abrasion resistant copper alloy of the second aspect will be discussed further in detail with reference to Examples and Comparative Examples.

EXAMPLES 2-1 to 2-6 and COMPARATIVE EXAMPLES 2-1 and 2-2

Raw materials (metals) were molten in a graphite crucible by using a high frequency induction furnace to obtain a copper alloy molten metal having a composition shown in the column of Examples 2-1 to 2-6 in Table 6 and Comparative Examples 2-1 and 2-2 in Table 7. The copper alloy molten metal was then cast to form an ingot. The ingot was subjected to hot forging and hot extrusion at 780° C. to form an extruded material. Subsequently, cutting was made on the extruded material thus producing a valve seat of Examples 2-1 to 2-6 and Comparative Examples 2-1 and 2-2. The valve seat was press-fitted at an exhaust side of an actual cylinder head formed of an aluminum alloy for the purpose of abrasion resistance evaluation.

EXAMPLE 2-7 and COMPARATIVE EXAMPLE 2-3

Raw materials (metals) were molten in a graphite crucible by using a high frequency induction furnace to obtain a copper alloy molten metal having a composition shown in the column of Example 2-7 in Table 6 and Comparative Examples 2-3 in Tables 7. The copper alloy molten metal was powdered by gas atomization and then subjected to dehydration and particle size distribution control thereby producing metal powder for powder metallurgy. After lubricant was added to the metal powder, the metal powder was molded into a predetermined shape and dewaxed. Thereafter, the molded metal powder was sintered thus producing a valve seat of Example 2-7 and Comparative Example 2-3. The thus produced valve seat was press-fitted at an exhaust side of an actual cylinder head formed of an aluminum alloy, for the purpose of abrasion resistance evaluation.

EXAMPLES 2-8 and 2-9 and COMPARATIVE EXAMPLE 2-4

Raw materials (metals) were molten in a graphite crucible by using a high frequency induction furnace to obtain a copper alloy molten metal having a composition shown in the column of Examples 2-8 and 2-9 and Comparative Example 2-4 in Table 2. The copper alloy molten metal was powdered by gas atomization and then subjected to dehydration and particle size distribution control thereby producing metal powder for padding or overlaying. The metal powder was immediately padded or overlaid in a thickness of not less than 3 mm on a groove which was formed by machining a valve seat portion of an actual cylinder head formed of an aluminum alloy, by using $CO_2$ gas laser of 5 kW. Thereafter, machining was made on the thus formed padded or overlaid layer thus obtaining the actual cylinder head provided with the valve seat of Examples 2-8 and 2-9 and Comparative Example 2-4 for purpose of abrasion resistance evaluation.

MICROSCOPE OBSERVATION OF STRUCTURE

Microscope observation was made on the structure of each of the valve seats of Examples 2-1 to 2-9 and Comparative Examples 2-1 to 2-4 to inspect intermetallic compounds precipitated in the structure. The results of the observation are shown in Tables 3 and 4. Additionally, the volume percentage of the precipitated intermetallic compounds in the structure was inspect to obtain the results shown also in Tables 8 and 9.

It was recognized that it was preferable that the precipitated amount of the intermetallic compounds mainly containing V, Nb, Ta or the like of the group Va elements was 1 to 50% by volume relative to the copper alloy, throughout Examples 2-1 to 2-9.

ACTUAL ENGINE DURABILITY TEST

Each of the above cylinder heads obtained in Examples 2-1 to 2-9 and Comparative Examples 2-1 to 2-4 was assembled in an actual engine and subjected to a durability engine test in which the engine was operated under conditions shown in Table 10.

After the engine test, measurement of the abrasion amount (or abrasion depth) and observation of the sliding surface were made for each valve seat to obtain the results shown in Tables 8 and 9. Concerning the valve seat of Comparative Example 2-4, the padded or overlaid layer (portion) was peeled off from the cylinder head of the aluminum alloy when the time of the engine test reached 60 hours, and the engine was stopped, so that the abrasion amount could not be measured.

As apparent from the experimental results shown in Tables 6 to 9, the valve seats of Examples 2-1 to 2-9 were all small in abrasion amount thereby exhibiting an excellent abrasion resistance. Observation of the sliding surface of the valve seats of Examples by a scanning electron microscope demonstrated that only shallow abrasion trace due to frictional action with a valve was found at the sliding surface without making abnormality such as corrosion or the like.

Additionally, it was recognized that the valve seat (Example 2-6) formed of the molten metal material and the valve seat (Example 2-7) formed of the sintered metal material were generally similar in abrasion resistance. In case of using the sintered metal material, although an operation step for preparing the metal powder is required, an intermediate product could be formed in a shape (or a near-net-shape) similar to the final product so that there was an advantage in which machining efficiency and material yield in mass production is high.

The valve seats (Examples 2-8 and 2-9) formed of the padded or overlaid material exhibited an excellent abrasion resistance over the above valve seats formed of the molten or sintered metal materials. The reason why such an effect was obtained was guessed as follows: The instant that the molten alloy powder was padded or overlaid on the cylinder head formed of the aluminum alloy high in heat conductivity during the padding or overlaying process, it was rapidly cooled and solidified so that the padded or overlaid layer was made harder than the molten or sintered materials.

On the contrary, regarding the valve seats of Comparative Examples 2-1 to 2-4, large abrasion was made in the valve seats (Comparative Examples 2-1 and 2-2) formed of the molten metal material and the valve seat (Comparative Example 2-3) formed of the sintered metal material. Additionally, difficulties encountered in the valve seat (Comparative Example 2-4) formed of the padded or overlaid material, in which the padded or overlaid layer peeled off from the cylinder head.

Observation of the valve seats of Comparative Examples 2-1 to 2-3 by the scanning electron microscope revealed that many pittings were formed on the sliding face of all of them. Additionally, a characteristic X-ray image was taken for the elements Ti, Cl and Br in each of these valve seats, which demonstrated that these elements were segregated at the peripheral portion of pitting. The reason why the pittings were formed in the valve seats of Comparative Examples were guessed as follows: Ethylene dichloride and/or ethylene dibromide contained as a lead removing agent in leaded gasoline were mixed as $PbCl_2$ and/or $PbBr_2$ into combustion gas and deposited on the surface of the valve seat. Ti contained in the valve seat of Comparative Examples reacted with Cl and Br of the above deposited compounds to make a tribo-chemical reaction. This makes a selective corrosion in the structure thus forming the pittings (pitting corrosion) on the surface of the valve seats of Comparative Examples.

Concerning the valve seat (Comparative Example 4) of the padding material, it was guessed that the padded or overlaid layer (portion) was peeled and dropped off because the padded or overlaid layer (portion) was largely embrittled under the combination of the above halogen corrosion effect during the engine test and Ti oxidation during padding or overlaying in atmospheric air.

According to the second aspect of the present invention, in order to promote precipitation of hard intermetallic compounds greatly contributing to improvement of abrasion resistance, V, Nb and/or Ta of the group Va elements were contained in the copper alloy so that the intermetallic compounds having a grain diameter of about 10 μm were formed in the structure. It will be understood that the intermetallic compounds of such a character were not found in the copper alloys of Comparative Examples.

Figure 2:
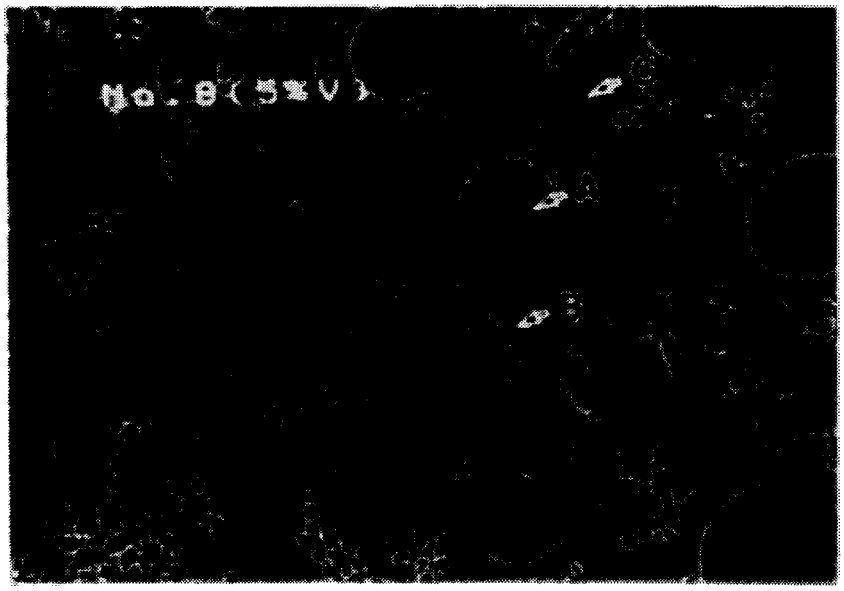
FIG. 2 is a microphotograph (at 1000 magnifications) of the structure of a valve seat of Example 2-6, taken through a scanning electron microscope.

Microscope observation of the copper alloys of typical ones of Examples and Comparative Examples will de discussed. FIG. 1 shows the structure of the copper alloy of the valve seat of Comparative Example 2-2 as a photograph (at 400 magnifications) taken through an optical microscope. FIG. 2 shows the structure of the copper alloy of the valve seat of Example 2-6 as a photograph (1000 magnifications) taken through a scanning electron microscope.

In FIG. 2, the character B indicates fine intermetallic compound which is similar in shape to that shown in FIG. 1. In FIG. 2, the character A indicates a spherical intermetallic compound having a grain diameter of about 10 μm. Such an intermetallic compound is not found in FIG. 1. It has been guessed that the large spherical precipitate (intermetallic compound) offered a great improvement effect in abrasion resistance against deposit and abrasive powder (material), so that the copper alloy of the second aspect exhibited the excellent abrasion resistance.

As appreciated from the above, the copper alloy of the second aspect of the present invention exhibits excellent abrasion resistance, oxidation resistance and corrosion resistance at high temperatures.

While only the valve seats have been discussed as the embodiments of the present invention, it will be appreciated that valve guides may be produced by the process of casting-forging-extrusion, the sintering or the like. It will be understood that the copper alloys of the present invention may be used for the material of a variety of sliding members requiring characteristics and performances similar to those of valve seats and valve guides.

TABLE 1

| | | Composition (wt %) | | | | | | | | Precipitated intermetallic compound pqr | | State after abrasion test | |
|---|---|---|---|---|---|---|---|---|---|---|---|---|---|
| | | | | | | | | | | uvw | | Abrasion | |
| Item | | Al | Ti | Co | Fe | Ni | Mn | Cu+ impurities | Production method | xyz αβγ | Factor | amount (μm) | Appearance |
| Example | 1-1 | 1.1 | 0.3 | — | — | — | — | Balance | Casting + hot forging + hot extrusion | AlxTiy | | 28 | Normal |
| | 1-2 | 10.2 | 5.1 | — | — | — | — | Balance | Casting + hot forging + hot extrusion | AlxTiy CuzTiw | | 25 | Normal |
| | 1-3 | 14.5 | 8.0 | — | — | — | — | Balance | Casting + hot forging + hot extrusion | AlxTiy CuzTiw | | 23 | Normal |
| | 1-4 | 10.3 | 5.3 | 1.0 | — | — | — | Balance | Casting + hot forging + hot extrusion | AlxTiyCoz CupTiq | | 22 | Normal |

TABLE 1-continued

| Item | | Composition (wt %) Al | Ti | Co | Fe | Ni | Mn | Cu+ impurities | Production method | Precipitated intermetallic compound pqr uvw xyz αβγ | Factor | State after abrasion test Abrasion amount (μm) | Appearance |
|---|---|---|---|---|---|---|---|---|---|---|---|---|---|
| | 1-5 | 10.3 | 5.2 | 9.7 | — | — | — | Balance | Casting + hot forging + hot extrusion | AlxTiyCoz CupTiq CoαTiβ | | 20 | Normal |

TABLE 2

| Item | | Composition (wt %) Al | Ti | Co | Fe | Ni | Mn | Cu+ impurities | Production method | Precipitated intermetallic compound pqr uvw xyz αβγ | Factor | State after abrasion test Abrasion amount (μm) | Appearance |
|---|---|---|---|---|---|---|---|---|---|---|---|---|---|
| Example | 1-6 | 10.4 | 6.0 | 7.2 | 1.1 | — | — | Balance | Casting + hot forging + hot extrusion | AlxTiyCoz AlαTiβCuγ | | 18 | Normal |
| | 1-7 | 9.9 | 6.4 | 7.1 | 3.3 | — | — | Balance | Casting + hot forging + hot extrusion | AlxTiyCoz FepAlq TiαCuβCoγ | | 17 | Normal |
| | 1-8 | 10.1 | 6.3 | 7.2 | 3.2 | 2.4 | — | Balance | Casting + hot forging + hot extrusion | AlxTiyCoz CoαTiβ CuvCow FepAlq | | 15 | Normal |
| | 1-9 | 10.3 | 5.4 | 7.3 | 3.1 | 4.3 | — | Balance | Casting + hot forging + hot extrusion | AlxTiyCoz CoαTiβ CuvCow NipAlq | | 11 | Normal |
| | 1-10 | 10.0 | 5.0 | — | 3.3 | 4.2 | 1.2 | Balance | Sintering | AlαTiβCoγ FexNiyAlz | | 10 | Normal |

TABLE 3

| Item | | Composition (wt %) Al | Ti | Co | Fe | Ni | Mn | Cu+ impurities | Production method | Precipitated intermetallic compound pqr uvw xyz αβγ | Factor | State after abrasion test Abrasion amount (μm) | Appearance |
|---|---|---|---|---|---|---|---|---|---|---|---|---|---|
| Example | 1-11 | 10.1 | 5.2 | 7.4 | 3.2 | — | 9.3 | Balance | Padding | AlxTiyCoz CoαTiβ NipAlq | | 5 | Normal |
| | 1-12 | 10.3 | 5.5 | 7.3 | 3.3 | 4.7 | 5.2 | Balance | Casting + hot forging + hot extrusion | AlxTiyCoz FeαAlβ NipAlq | | 7 | Normal |
| | 1-13 | 15.0 | 8.0 | — | — | — | — | Balance | Sintering | AlxTiy TipCuq | | 24 | Normal |
| | 1-14 | 10.2 | 5.7 | 8.5 | — | — | — | Balance | Padding | AlxTiyCoz TipCoq | | 18 | Normal |
| | 1-15 | 10.3 | 6.2 | 7.2 | 3.2 | — | — | Balance | Sintering | AlxTiyCoz FepAlq | | 17 | Normal |
| | 1-16 | 10.2 | 6.2 | 7.3 | 3.3 | 4.5 | | Balance | Padding | AlxTiyCoz FepNiqAlr | | 9 | Normal |

TABLE 4

| Item | | Composition (wt %) Al | Ti | Co | Fe | Ni | Mn | Cu+ impurities | Production method | Precipitated intermetallic compound pqr uvw xyz αβγ | Factor | State after abrasion test Abrasion amount (μm) | Appearance |
|---|---|---|---|---|---|---|---|---|---|---|---|---|---|
| Comparative example | 1-1 | 0.5 | 0.4 | — | — | — | — | Balance | Casting + hot forging + hot extrusion | Nil | | 53 | Normal |
| | 1-2 | 17.3 | 11.2 | — | — | — | — | Balance | Casting + hot forging + hot extrusion | AlxTiy CupTiq | | 16 | Oxidation-heavy Pitting found |
| | 1-3 | — | — | 3.2 | 1.3 | 2.1 | 3.4 | Balance | Sintering | Nil | | 45 | Normal |
| | 1-4 | — | 5.1 | 7.3 | 3.3 | 2.3 | 5.2 | Balance | Padding | TixCoy | | 40 | Normal |

TABLE 5

| Item | | Composition (wt %) Al | Ti | Co | Fe | Ni | Mn | Cu+ impurities | Production method | Precipitated intermetallic compound pqr uvw xyz αβγ | Factor | State after abrasion test Abrasion amount (μm) | Appearance |
|---|---|---|---|---|---|---|---|---|---|---|---|---|---|
| Composition example | 1-5 | 10.2 | — | 0.3 | 3.5 | 2.4 | 7.1 | Balance | Casting + hot forging + hot extrusion | FexNiyAlz | | 42 | Normal |
| | 1-6 | 10.3 | 6.3 | — | 12.7 | 10.3 | — | Balance | Sintering | FexNiy TipAlq | | 12 | Pitting found |
| | 1-7 | 10.2 | 5.4 | 3.3 | 3.1 | 2.5 | 15 | Balance | Padding | AlxTiyCoz TipCuq TiαCoβ | | 18 | Pitting found |
| | 1-8 | 2.6 | 3.8 | 1.7 | — | — | — | Balance | Sintering | Nil | | 40 | Normal |

TABLE 6

| Item | | Composition (wt %) Al | Co | Va group element | Ti | Fe | Ni | Mn | Cu+ impurities | Production method |
|---|---|---|---|---|---|---|---|---|---|---|
| Example | 2-1 | 1.7 | — | V: 0.2 | — | — | — | — | Balance | Casting + hot forging + hot extrusion |
| | 2-2 | 10.1 | — | V: 1.5 | — | — | — | — | Balance | Casting + hot forging + hot extrusion |
| | 2-3 | 10.3 | 5.4 | V: 2.5 | — | — | — | — | Balance | Casting + hot forging + hot extrusion |
| | 2-4 | 10.1 | 6.0 | Nb: 2.1 | — | — | — | — | Balance | Casting + hot forging + hot extrusion |
| | 2-5 | 10.4 | 6.3 | Ta: 1.8 | — | — | — | — | Balance | Casting + hot forging + hot extrusion |
| | 2-6 | 10.1 | 5.5 | V: 2.5 | — | 3.1 | 4.5 | — | Balance | Casting + hot forging + hot extrusion |
| | 2-7 | 10.2 | 4.8 | V: 1.2 | — | 2.9 | 5.1 | 1.5 | Balance | Sintering |

TABLE 7

| Item | | Composition (wt %) | | | | | | | | |
|---|---|---|---|---|---|---|---|---|---|---|
| | | Al | Co | Va group element | Ti | Fe | Ni | Mn | Cu+ impurities | Production method |
| Example | 2-8 | 10.1 | 5.7 | V: 2.1 | — | 3.2 | 4.3 | 2.5 | Balance | Padding |
| | 2-9 | 10.2 | 5.1 | Nb: 1.8 | — | 3.5 | 4.7 | 2.4 | Balance | Padding |
| Comparative example | 2-1 | 1.1 | — | — | 0.3 | — | — | — | Balance | Casting + hot forging + hot extrusion |
| | 2-2 | 10.3 | 7.3 | — | 5.4 | 3.1 | 4.3 | — | Balance | Casting + hot forging + hot extrusion |
| | 2-3 | 10.3 | 7.2 | — | 6.2 | 3.2 | — | — | Balance | Sintering |
| | 2-4 | 10.1 | 7.4 | — | 5.2 | 3.2 | — | 9.3 | Balance | Padding |

TABLE 8

| Item | | Precipitated intermetallic compound pqr stu xyz αβ | Factor | Vol % of precipitated intermetallic compound | State after actual engine durability test: Abrasion amount (μm) | State after actual engine durability test: Appearance of sliding surface |
|---|---|---|---|---|---|---|
| Example | 2-1 | AlxVy | | 3 | 33 | Normal |
| | 2-2 | AlxVyCuz VsCut | | 7 | 25 | Normal |
| | 2-3 | AlxVyCoz VsCutCou | | 25 | 18 | Normal |
| | 2-4 | AlxNbyCoz NbsCutCou | | 30 | 15 | Normal |
| | 2-5 | AlxTayCoz TasCutCou | | 28 | 16 | Normal |
| | 2-6 | AlxVyCoz VsCutCou FepNiqAlr | | 35 | 11 | Normal |
| | 2-7 | AlxVyCoz VsCutCou FepNiqAlr | | 30 | 14 | Normal |

TABLE 9

| Item | Precipitated intermetallic compound pqr stu xyz αβ | Factor | Vol % of precipitated intermetallic compound | State after actual engine durability test: Abrasion amount (μm) | State after actual engine durability test: Appearance of sliding surface |
|---|---|---|---|---|---|
| Example | 2-8 AlxVyCoz VsCutCou FepNiqAlr | | 27 | 5 | Normal |
| | 2-9 AlxNbyCoz NbsCutCou FepNiqAlr | | 31 | 5 | Normal |
| Comparative example | 2-1 AlxTiy | | 2 | 75 | Pitting corrosion found |
| | 2-2 AlxTiyCoz CoαTiβ CutCou NipAlq | | 20 | 83 | Pitting corrosion found |
| | 2-3 AlxTiyCoz FepAlq | | 17 | 125 | Pitting corrosion found |
| | 2-4 AlxTiyCoz FeαAlβ NipAlq | | 18 | Could not be measured | Padded portion peeled off in the course of durability test |

TABLE 10

| Item | Content |
|---|---|
| Used engine | 2000 cc, inline 4 cylinder SOHC |
| Used fuel | Leaded gasoline (3 g Pb/US gallon) |
| Engine speed | 6000 r.p.m |
| Temperature of exhaust valve seat | 300° C. |
| Test time | 100 hrs. |

What is claimed is:

1. A high temperature abrasion resistant copper alloy consisting essentially of:

aluminum in an amount ranging from 1.0 to 15.0% by weight;

cobalt in an amount ranging from 0.5 to 10.0% by weight;

titanium in an amount ranging from 0.3 to 8.0% by weight; and balance containing copper and impurities;

said copper alloy having a structure in which at least one of intermetallic compounds is dispersed, each intermetallic compound containing at least two metals selected from the group consisting of aluminum, titanium, cobalt and copper.

2. A high temperature abrasion resistant copper alloy as claimed in claim 1, further comprising at least one of iron and nickel in an amount in total ranging from 0.5 to 12.0% by weight, said copper alloy having a structure in which at least one of intermetallic compounds is dispersed, each intermetallic compound containing at least two metals selected from the group consisting of aluminum, titanium, cobalt, iron, nickel and copper.

3. A high temperature abrasion resistant copper alloy as claimed in claim 1, further comprising manganese in an amount ranging from 1.0 to 10.0% by weight relative to the copper alloy.

4. The high temperature abrasion resistant copper alloy of claim 1 wherein said titanium ranges from 5.0 to 8.0% by weight.

* * * * *